US011294316B2

(12) United States Patent
Park et al.

(10) Patent No.: US 11,294,316 B2
(45) Date of Patent: Apr. 5, 2022

(54) REMAINING LIFE INFORMATION OF TONER CARTRIDGE IS PROVIDED USING WEIGHT OF TONER CARTRIDGE

(71) Applicant: Hewlett-Packard Development Company, L.P., Spring, TX (US)

(72) Inventors: Youngjin Park, Seongnam-si (KR); Yonghun Kim, Seongnam-si (KR); Sowon Sheen, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/270,907

(22) PCT Filed: Aug. 28, 2019

(86) PCT No.: PCT/US2019/048584
§ 371 (c)(1),
(2) Date: Feb. 24, 2021

(87) PCT Pub. No.: WO2020/171847
PCT Pub. Date: Aug. 27, 2020

(65) Prior Publication Data

US 2021/0216030 A1 Jul. 15, 2021

(30) Foreign Application Priority Data

Feb. 21, 2019 (KR) ..... 10-2019-0020573

(51) Int. Cl.
*G03G 15/00* (2006.01)
*G03G 15/08* (2006.01)

(52) U.S. Cl.
CPC ..... *G03G 15/556* (2013.01); *G03G 15/0856* (2013.01); *G03G 15/5016* (2013.01)

(58) Field of Classification Search
CPC ..... G03G 15/556; G03G 15/0856; G03G 15/5016; B41B 3/28; B41J 2/17566; B41J 2002/17589
(Continued)

(56) References Cited

U.S. PATENT DOCUMENTS 6,810,218 B1 10/2004 Wong et al.
7,415,214 B2 8/2008 Sakita et al.
(Continued)

FOREIGN PATENT DOCUMENTS

JP 2010-131814 A 6/2010
KR 1999-0008965 A 2/1999
(Continued)

*Primary Examiner* — Robert B Beatty
(74) *Attorney, Agent, or Firm* — Jefferson IP Law, LLP

(57) ABSTRACT

An operating method of an image forming apparatus including estimating an accumulative usage of toner in a toner cartridge, determining initial remaining life information of the toner cartridge and indicating a remaining amount of the toner based on the estimated accumulative usage of the toner, obtaining weight information indicating a first weight of the toner cartridge at a first time point at which the remaining amount of the toner is within a predetermined range, determining a correction factor indicating an error factor between the estimated accumulative usage of the toner and an actual accumulative usage of the toner, based on the obtained weight information and the estimated accumulative usage, and correcting an amount of toner to be used in an image forming operation to be performed after the first time point based on the correction factor, and determining adjusted remaining life information based on the correction factor.

20 Claims, 11 Drawing Sheets

(58) Field of Classification Search
USPC ..... 399/27, 61; 347/6, 7; 141/83
See application file for complete search history.

(56) References Cited

U.S. PATENT DOCUMENTS

| | | | | |
|---|---|---|---|---|
| 9,477,174 | B1 | 10/2016 | Hill et al. | |
| 2002/0037177 | A1* | 3/2002 | Kanoshima | G03G 15/5079 399/79 |
| 2002/0141765 | A1* | 10/2002 | Phillips | G03G 15/0856 399/27 |
| 2007/0058996 | A1* | 3/2007 | Sakita | G03G 15/553 399/27 |
| 2009/0047044 | A1* | 2/2009 | Sakita | G03G 15/0868 399/258 |
| 2009/0153602 | A1* | 6/2009 | Brown | B41J 2/17546 347/7 |
| 2015/0003847 | A1 | 1/2015 | Yang et al. | |
| 2015/0063839 | A1 | 3/2015 | Takahashi | |
| 2015/0301476 | A1* | 10/2015 | Leemhuis | G03G 15/0863 399/83 |
| 2019/0235434 | A1* | 8/2019 | Kawaguchi | G03G 15/5079 |
| 2020/0201228 | A1* | 6/2020 | Kawaguchi | G03G 15/5079 |

FOREIGN PATENT DOCUMENTS

| | | | |
|---|---|---|---|
| KR | 10-2006-0029553 | A | 4/2006 |
| WO | WO-2005/077657 | A1 | 8/2005 |

* cited by examiner

810

| M(g) | m_used | A | R_calc | R_actual |
|---|---|---|---|---|
| 1260 | 0 | 0 | 100% | 100% |
| 1170 | 90 | 41185314 | 92% | 91% |
| 1076 | 184 | 84765123 | 83% | 81% |
| 986 | 274 | 122258235 | 76% | 72% |
| 875 | 385 | 169148135 | 66% | 61% |
| 810 | 450 | 203799045 | 59% | 54% |
| 695 | 565 | 250099955 | 50% | 43% |
| 560 | 700 | 304414441 | 39% | 29% |
| 500 | 760 | 332126361 | 34% | 23% |
| 370 | 890 | 395605251 | 21% | 10% |
| 275 | 985 | 435954050 | 13% | 0% |

820

910

| M(g) | m_used | A' | R_calc' | R_actual |
|---|---|---|---|---|
| 1260 | 0 | 0 | 100% | 100% |
| 1170 | 90 | 41185314 | 92% | 91% |
| 1076 | 184 | 84765123 | 83% | 81% |
| 986 | 274 | 122258235 | 76% | 72% |
| 875 | 385 | 169148135 | 66% | 61% |
| 810 | 450 | 203799045 | 59% | 54% |
| 695 | 565 | 255695019 | 49% | 43% |
| 560 | 700 | 316572941 | 37% | 29% |
| 500 | 760 | 347633607 | 30% | 23% |
| 370 | 890 | 418783371 | 16% | 10% |
| 275 | 985 | 464007973 | 7% | 0% |

920

1010

| M(g) | m_used | A" | R_calc" | R_actual |
|---|---|---|---|---|
| 1260 | 0 | 0 | 100% | 100% |
| 1170 | 90 | 41185314 | 92% | 91% |
| 1076 | 184 | 84765123 | 83% | 81% |
| 986 | 274 | 122258235 | 76% | 72% |
| 875 | 385 | 169148135 | 66% | 61% |
| 810 | 450 | 228426396 | 54% | 54% |
| 695 | 565 | 280322370 | 44% | 43% |
| 560 | 700 | 341200292 | 32% | 29% |
| 500 | 760 | 372260958 | 26% | 23% |
| 370 | 890 | 443410722 | 11% | 10% |
| 275 | 985 | 488635324 | 2% | 0% |

1020

REMAINING LIFE INFORMATION OF TONER CARTRIDGE IS PROVIDED USING WEIGHT OF TONER CARTRIDGE

BACKGROUND

An image forming apparatus using an electro-photographic method forms a visible toner image on a photoconductor by supplying toner to an electrostatic latent image formed on the photoconductor, transfers the toner image by using an intermediate transfer medium or a direct transfer medium, and then fixes the transferred toner image on a print medium.

In other words, the image forming apparatus uses the toner to print the toner image on the print medium. As the toner is used in each image forming operation, the toner is used up after a certain time period. In this case, a component for storing the toner may be replaced, or toner may be refilled in the component for storing the toner.

DETAILED DESCRIPTION OF EXAMPLES

"An image forming apparatus" may indicate any type of apparatus capable of performing an image forming operation, for example, a printer, a scanner, a fax machine, a multi-function printer (MFP), or a display apparatus. "An image forming operation" may be at least one of print, scan, and fax.

Hereinafter, examples of the present disclosure will be described in detail with reference to the attached drawings such that the present disclosure may be easily embodied by those one of ordinary skill in the art. However, the present disclosure may be differently embodied in numerous forms and is not limited to the examples set forth herein.

Figure 1:
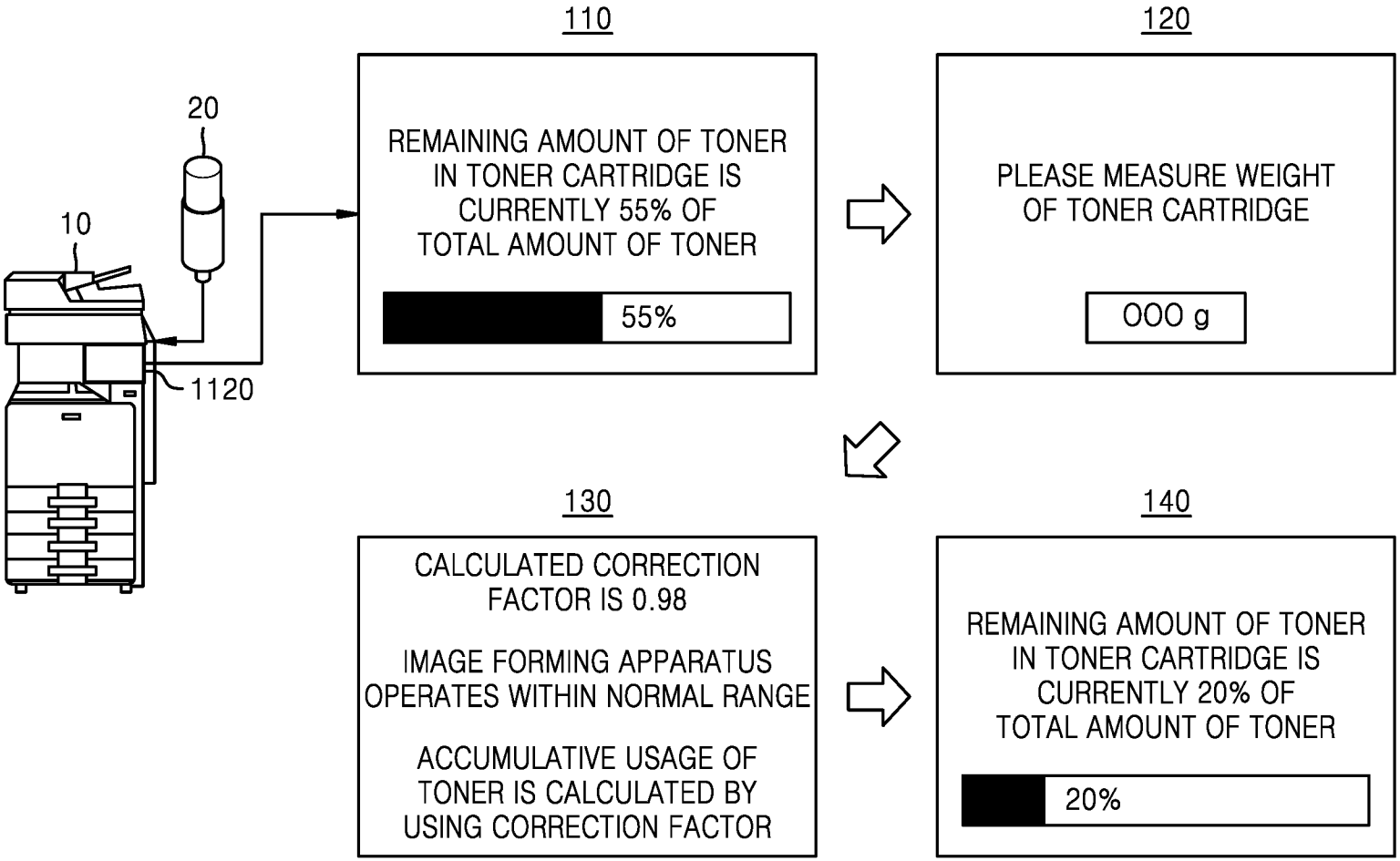
FIG. 1 is a conceptual diagram for describing an operation of an image forming apparatus that provides remaining life information of a toner cartridge, according to an example.

FIG. 1 is a conceptual diagram for describing an operation of an image forming apparatus that provides remaining life information of the toner cartridge, according to an example;

The toner cartridge may be mounted in a main body of the image forming apparatus 10 or removed from the main body of the image forming apparatus 10. The main body of the image forming apparatus 10 may include a communicating portion through which toner may be injected by a toner refill kit 20 when the toner cartridge is mounted in the main body of the image forming apparatus 10. As an image forming operation is performed in the image forming apparatus 10, the toner in the toner cartridge is used. As the toner is used, the image forming apparatus 10 may calculate an accumulative usage of the toner, based on the number of rotations of a driving component which rotates a feed member for feeding the toner, the rotation time, and the number of pixels of image data for forming a certain image.

Referring to an image 110 shown in FIG. 1, the image forming apparatus 10 may display remaining life information of the toner cartridge as the image forming operation is performed. The remaining life information of the toner cartridge may be obtained by subtracting the accumulative usage of the toner from a target usage of the toner. As it is shown in the image 110 of FIG. 1, the image forming apparatus 10 may display a message stating: "The remaining amount of the toner in toner cartridge is currently 55% of the total amount of the toner" and a bar indicating a remaining percentage of the toner.

Referring to an image 120 shown in FIG. 1, when a remaining amount of the toner is within a predetermined range, the image forming apparatus 10 may display a message to guide a user to measure a weight of the toner cartridge such that an error between the accumulative usage of the toner that is calculated and estimated in the image forming apparatus 10 and the actual accumulative usage of the toner is reduced. For example, the predetermined range may be a range from about 40% to about equal to or less than 60% of the toner initially charged in the toner cartridge. Meanwhile, the user may remove the toner cartridge from the image forming apparatus 10 to measure the weight of the toner cartridge. The user may input the weight of the toner cartridge by using a user interface 1120 in the image forming apparatus 10.

Referring to an image 130 shown in FIG. 1, the image forming apparatus 10 may, based on the weight of the toner cartridge, calculate the actual accumulative usage of the toner and a correction factor indicating an error rate between the estimated accumulative usage of the toner and the actual accumulative usage of the toner. When the correction factor is obtained, the image forming apparatus 10 may, based on the correction factor, diagnose whether the image forming apparatus 10 is in a normal state. The process in which the image forming apparatus 10 diagnoses whether the image forming apparatus 10 is in the normal state will be described with reference to FIG. 7. As it is shown in the image 130 of FIG. 1, the image forming apparatus 10 may display the calculated correction factor and information regarding the state of the image forming apparatus 10 that is diagnosed by using the correction factor.

Referring to an image 140 shown in FIG. 1, the image forming apparatus 10 may, by using the correction factor, obtain remaining life information of the toner cartridge based on the correction factor by calculating an amount of toner to be used in an image forming operation to be performed after the weight of the toner cartridge is measured. As it is shown in the image 140 shown in FIG. 1, the image forming apparatus 10 may display the remaining life information of the toner cartridge.

Figure 2:
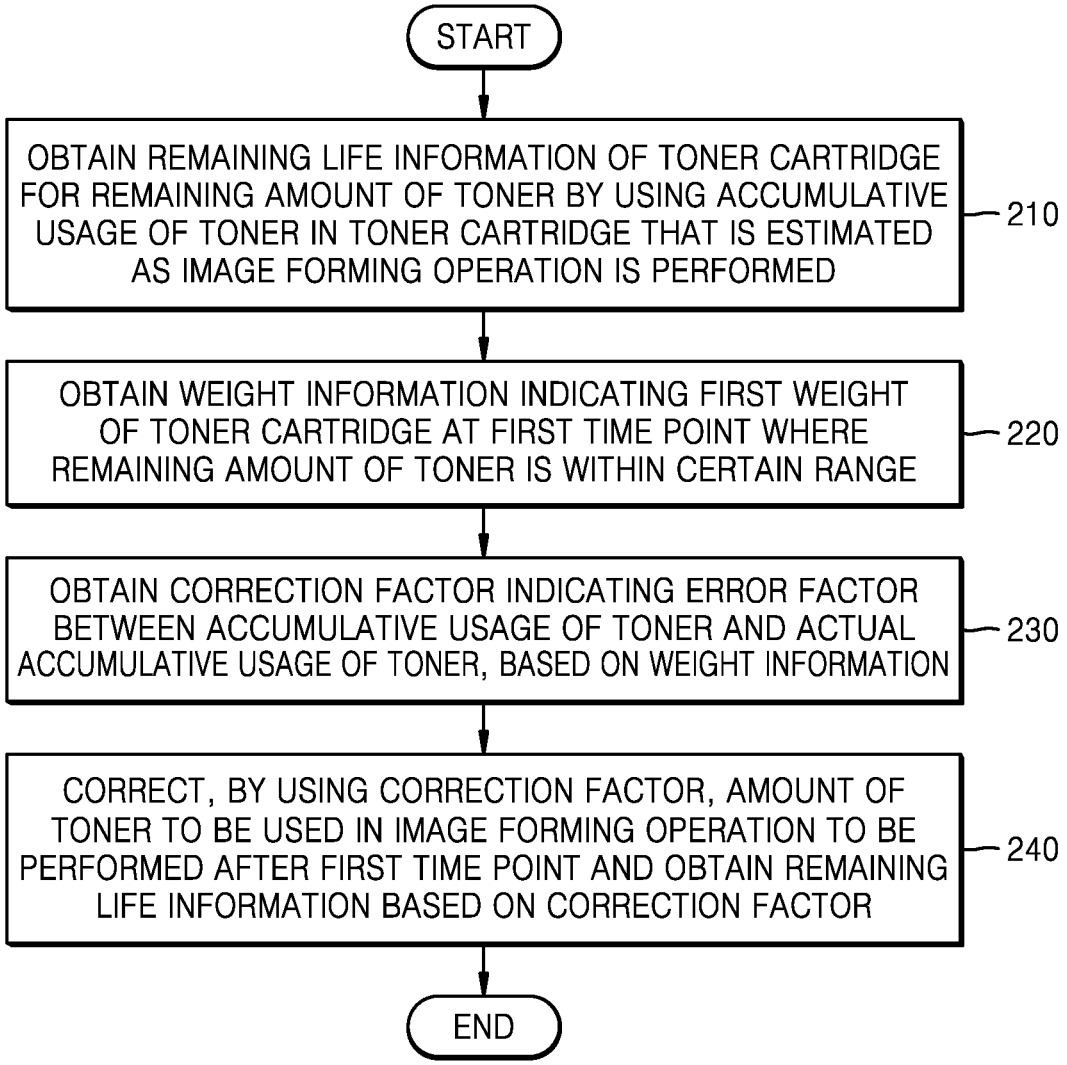
FIG. 2 is a flowchart of an operating method of an image forming apparatus, according to an example.

FIG. 2 is a flowchart of an operating method of the image forming apparatus 10, according to an example.

In operation 210 of the image forming apparatus 10, the image forming apparatus 10 may, as an image forming operation is performed, obtain the remaining life information of the toner cartridge for a remaining amount of toner by using the estimated accumulative usage of the toner in the toner cartridge. A process of obtaining the remaining life information of the toner cartridge by the image forming apparatus 10 will be described with reference to FIG. 3.

In operation 220 of the image forming apparatus 10, the image forming apparatus 10 may obtain weight information indicating a first weight of the toner cartridge at a first time point where the remaining amount of the toner is within a predetermined range. For example, the predetermined range may be a range from about 40% to about equal to or less than 60% of the toner initially charged in the toner cartridge. For example, the weight of the toner cartridge may be measured by a weight measuring apparatus when the toner cartridge is removed from the main body of the image forming apparatus 10. The image forming apparatus 10 may, via the user interface 1120, receive input of the weight information indicating the first weight of the toner cartridge.

In operation 230 of the image forming apparatus 10, the image forming apparatus 10 may, based on the weight information, obtain a correction factor indicating an error rate between the accumulative usage of the toner and the actual accumulative usage. The error between the estimated accumulative usage of the toner and the actual accumulative usage of the toner may occur due to mechanical characteristics of components in the image forming apparatus 10, a pattern of the image forming operation performed in the image forming apparatus 10, and a usage environment of the image forming apparatus 10. The correction factor may be used for reducing the error rate between the accumulative usage of the toner and the actual accumulative usage of the toner. A process of obtaining the correction factor by the image forming apparatus 10 will be described with reference to FIG. 4.

With the toner cartridge mounted in a main body of the image forming apparatus 10 and not replaced, the correction factor may be reestablished each time when weight information of the toner cartridge is obtained.

Meanwhile, the correction factor may be calculated by using a rate of the actual accumulative usage to the estimated accumulative usage. Thus, the correction factor may be an index indicating the efficiency or characteristics of toner supply in the image forming apparatus 10.

For example, when the toner in the toner cartridge is directly supplied to a developing portion in the image forming apparatus 10, physical characteristics of the toner cartridge may affect the estimation of the accumulative usage of the toner. Therefore, the image forming apparatus 10 may reset the correction factor each time the toner cartridge is replaced. When weight information of the replaced toner cartridge is obtained, the image forming apparatus 10 may reestablish the correction factor, based on the weight information of the replaced toner cartridge.

As another example, when the toner in the toner cartridge is indirectly supplied to the developing portion in the image forming apparatus 10 via a certain storage space, physical characteristics of the certain storage space may affect the estimation of the accumulative usage of the toner. Therefore, when the certain storage space is replaced, the image forming apparatus 10 may reset the correction factor each time the certain storage space is replaced. On the other hand, when the certain storage space is not replaced, the image forming apparatus 10 may update a next correction factor based on a previous correction factor, as weight information of the toner cartridge is obtained.

In addition, the correction factor may be used for diagnosing the state of the image forming apparatus 10. A process of diagnosing the state of the image forming apparatus 10 by using the correction factor will be described with reference to FIG. 7.

In operation 240 of the image forming apparatus 10, the image forming apparatus 10 may, by using the correction factor, correct an amount of toner to be used in the image forming operation to be performed after the first time point and obtain remaining life information based on the correction factor. A process of obtaining the remaining life information based on the correction factor by the image forming apparatus 10 will be described with reference to FIGS. 5 and 6.

The image forming apparatus 10 may display the remaining life information through the user interface 1120. For example, the image forming apparatus 10 may, on the user interface 1120, display the remaining life information that includes information regarding a remaining amount of the toner, a remaining percentage of the toner, and an accumulative usage of the toner in the toner cartridge.

Figure 3:
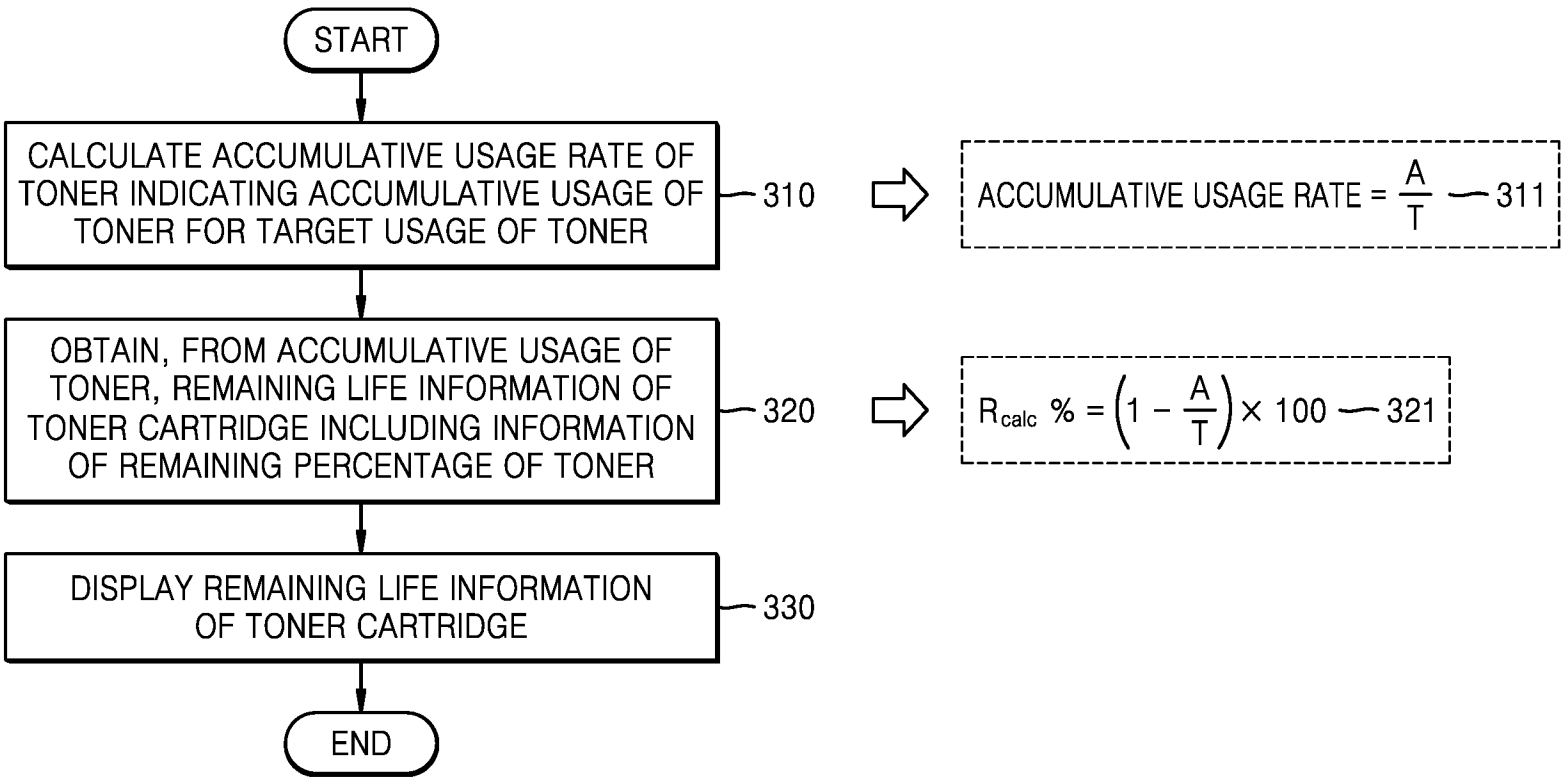
FIG. 3 is a diagram for describing a process of obtaining, by the image forming apparatus, remaining life information of the toner cartridge, according to an example.

FIG. 3 is a diagram for describing a process of obtaining, by the image forming apparatus 10, remaining life information of the toner cartridge, according to an example.

In operation 310 of the image forming apparatus 10, the image forming apparatus 10 may calculate an accumulative usage rate of the toner. The usage rate of the toner indicates an accumulative usage of the toner to the target usage of the toner.

The image forming apparatus 10 may calculate the accumulative usage of the toner, based on at least one of the number of rotations of the driving component rotating the feed member for feeding the toner in the toner cartridge, the driving time of the driving component, and the number of pixels of the image data for forming an image. For example, the image forming apparatus 10 may accumulate the number of rotations of the driving component rotating the feed member and calculate the accumulative usage of the toner, according to an amount of toner ejected for each rotation.

Referring to Equation 311 shown in FIG. 3, the image forming apparatus 10 may calculate a rate of the accumulative usage of the toner to the target usage of the toner as the accumulative usage rate of the toner. In Equation 311 of FIG. 3, T indicates the target usage of the toner and A indicates the accumulative usage of the toner. The target usage of the toner may be determined by an amount of toner that is initially charged in the toner cartridge.

In operation 320 of the image forming apparatus 10, the image forming apparatus 10 may, from the accumulative usage of the toner, obtain remaining life information of the toner cartridge. The remaining life information of the toner cartridge includes information regarding a remaining percentage of the toner.

Referring to Equation 321 shown in FIG. 3, the remaining percentage of the toner may be calculated when the accumulative usage of the toner is subtracted from an initial remaining percentage 1 of the toner in the toner cartridge. In other words, the image forming apparatus 10 may obtain the remaining life information of the toner cartridge. The remaining life information includes information regarding the remaining percentage of the toner. In Equation 321 of FIG. 3, $R_{calc}$ indicates the remaining life information of the toner cartridge.

In operation 330 of the image forming apparatus 10, the image forming apparatus 10 may display the remaining life information of the toner cartridge.

Figure 4:
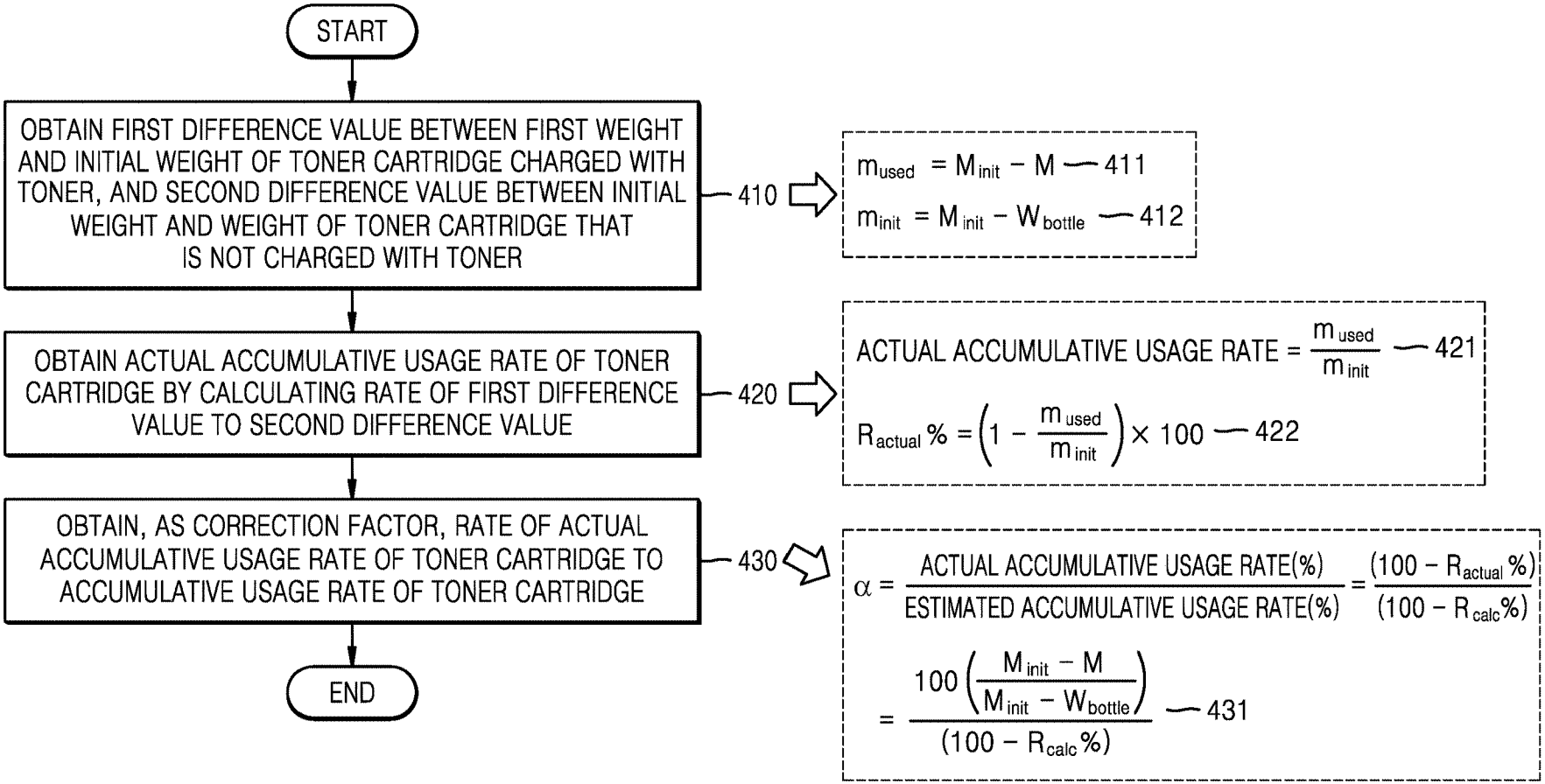
FIG. 4 is a diagram for describing a process of obtaining, by the image forming apparatus, a correction factor indicating an error factor between an estimated accumulative usage and an actual accumulative usage, according to an example.

FIG. 4 is a diagram for describing a process of obtaining, by the image forming apparatus 10, a correction factor indicating an error factor between an estimated accumulative usage and an actual accumulative usage, according to an example.

In operation 410 of the image forming apparatus 10, the image forming apparatus 10 may obtain a first difference value by calculating a difference between an initial weight of the toner cartridge in an initial state in which the toner cartridge is charged with the toner at an initial time point, and a first weight of the toner cartridge. Here, the first weight is a weight of the toner cartridge measured at the first time point. The first difference value is an actual accumulative usage of the toner used in the toner cartridge from the initial time point to the first time point. The first difference value may be calculated according to Equation 411 shown in FIG. 4.

In Equation 411 of FIG. 4, $M_{int}$ indicates the initial weight of the toner cartridge in the initial state in which the toner cartridge is charged with the toner at the initial time point, M indicates a weight of the toner cartridge measured at a certain time point, and mused is the actual accumulative usage of the toner that is used in the toner cartridge from the initial time point to the certain time point.

In operation 410 of the image forming apparatus 10, the image forming apparatus 10 may obtain a second difference value by calculating a difference between the initial weight of the toner cartridge charged with the toner and the weight of the toner cartridge that is not charged with the toner. The second difference value is an amount of toner initially charged in the toner cartridge. That is, the second difference value may be the target usage. The second difference value may be calculated according to Equation 412 shown in FIG. 4.

In Equation 412 of FIG. 4, $W_{bottle}$ indicates the weight of the toner cartridge in a state in which the toner cartridge is not charged with the toner. In other words, $W_{bottle}$ indicates the weight of the toner cartridge that is not charged with the toner. And $m_{int}$ indicates the amount of toner initially charged in the toner cartridge.

In operation 420 of the image forming apparatus 10, the image forming apparatus 10 may obtain an actual accumulative usage rate of the toner cartridge by calculating a rate of the first difference value to the second difference value. The actual accumulative usage rate may be calculated according to Equation 421 shown in FIG. 4.

In addition, the image forming apparatus 10 may obtain actual remaining life information of the toner cartridge by using the actual accumulative usage rate. For example, an actual remaining percentage of the toner may be calculated when the actual accumulative usage rate of the toner is subtracted from the initial remaining percentage 1 of the toner in the toner cartridge. In other words, the image forming apparatus 10 may obtain the actual remaining life information of the toner cartridge. The actual remaining life information of the toner cartridge includes information regarding the actual remaining percentage of the toner. In Equation 422 of FIG. 4, $R_{actual}$ is the actual remaining life information of the toner cartridge.

In operation 430 of the image forming apparatus 10, the image forming apparatus 10 may, as a correction factor, obtain a rate of the actual accumulative usage rate of the toner cartridge to an accumulative usage rate of the toner cartridge. Also, the image forming apparatus 10 may, as the correction factor, obtain the rate of the actual accumulative usage of the toner in the toner cartridge to the accumulative usage of the toner of the toner in the toner cartridge.

The error between the estimated accumulative usage rate and the actual accumulative usage rate may occur because the estimated accumulative usage is not identical to an accumulative usage corresponding to an amount of toner that is actually used in the toner cartridge. Accordingly, when a correction factor adaptable to calculation of the accumulative usage is obtained by the image forming apparatus 10, the image forming apparatus 10 may reduce the error between the accumulative usage rate that is calculated and the actual accumulative usage rate.

In operation 431 shown in FIG. 4, the correction factor $\alpha$ may be calculated by using a rate of the actual accumulative usage rate of the toner cartridge to the estimated accumulative usage rate of the toner cartridge. Here, the estimated accumulative usage rate may be calculated according to Equation 311 of FIG. 3. The actual accumulative usage rate may be a value calculated by subtracting $R_{actual}$ % indicating the actual remaining life information of the toner cartridge from 100%. The estimated accumulative usage rate may be a value calculated by subtracting $R_{calc}$ % indicating the remaining life information of the toner cartridge from 100%. As defined in Equation 431 of FIG. 4, the actual accumulative usage rate may be represented by $M_{int}$ indicating the initial weight of the toner cartridge charged with the toner, M indicating the weight of the toner cartridge measured at a certain time point, and $W_{bottle}$ indicating the weight of the toner cartridge that is not charged with the toner.

Figure 5:
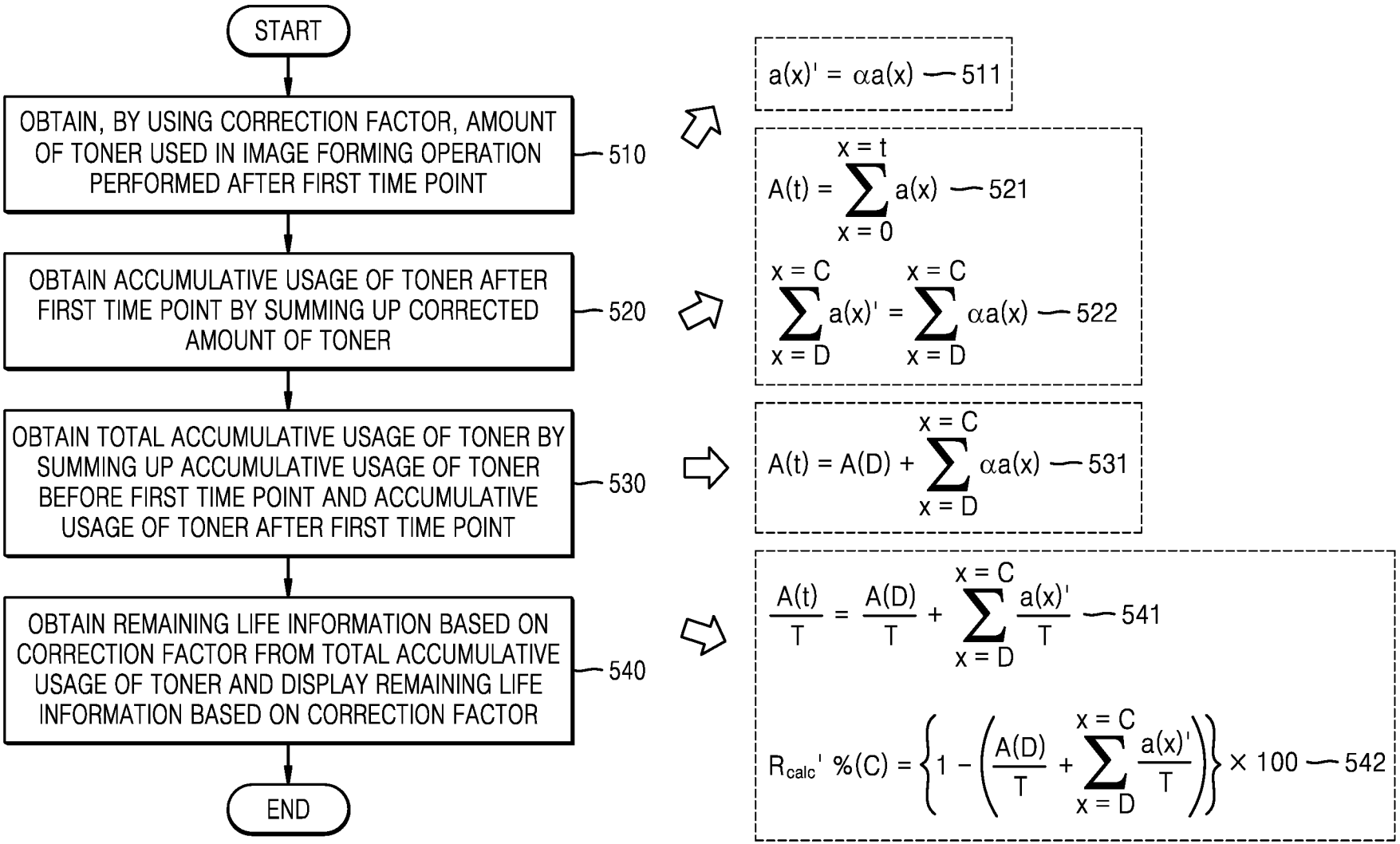
FIG. 5 is a diagram for describing a process of providing, by the image forming apparatus, remaining life information of the toner cartridge based on a correction factor, according to an example.

FIG. 5 is a diagram for describing a process of providing, by the image forming apparatus 10, remaining life information of the toner cartridge based on a correction factor, according to an example.

In operation 510 of the image forming apparatus 10, the image forming apparatus 10 may, by using the correction factor, correct the amount of toner to be used in the image forming operation to be performed after the first time point.

The image forming apparatus 10 may, according to Equation 511 shown in FIG. 5, correct an amount of toner to be used in an image forming operation to be performed at an x time point. Here, a(x) indicates an amount of toner used at the x time point.

For example, when an amount of toner to be used due to a first image forming operation to be performed at D+1 time point after the first time point D is calculated as a(D+1), the image forming apparatus 10 may obtain a corrected amount of toner a*a(D+1) by multiplying the correction factor $\alpha$ by the calculated amount of toner.

In operation 520 of the image forming apparatus 10, the image forming apparatus 10 may obtain an accumulative usage of the toner after the first time point by summing up corrected amounts of toner.

Equation 521 shown in FIG. 5 indicates an accumulative usage of the toner cartridge up to a certain time point t. The image forming apparatus 10 may obtain a corrected accumulative usage of the toner by applying the correction factor to Equation 521. More particularly, the image forming apparatus 10 may obtain an accumulative amount of toner at D time point by summing up corrected amounts of toner from D time point to C time point, according to Equation 522 shown in FIG. 5. Here, the C time point is later than the D time point.

In operation 530 of the image forming apparatus 10, the image forming apparatus 10 may obtain a total accumulative usage of the toner by summing up the accumulative usage of the toner before the first time point and the accumulative usage of the toner after the first time point.

For example, the image forming apparatus 10 may obtain a total accumulative usage to the C time point by summing up accumulative usage of the toner before the D time point and an accumulative usage of the toner from the D time point to the C time point, according to Equation 531 of FIG. 5. Referring to Equation 531, the correction factor is applied to the usage of toner calculated from the D time point. A method of applying the correction factor also to a usage of the toner calculated before the D time point will be described with reference to FIG. 6.

In operation 540 of the image forming apparatus 10, the image forming apparatus 10 may obtain the remaining life information based on the correction factor from the total accumulative usage of the toner. The image forming apparatus 10 may display the remaining life information based on the correction factor.

For example, the image forming apparatus 10 may obtain the accumulative usage of the toner by calculating a rate of the total accumulative usage of the target usage of the toner, according to Equation 541 shown in FIG. 5. The image forming apparatus 10 may calculate a remaining percentage of the toner based on the correction factor by subtracting the accumulative usage of the toner from the initial remaining percentage 1 of the toner in the toner cartridge.

In other words, the image forming apparatus 10 may obtain the remaining life information of the toner cartridge. The remaining life information of the toner cartridge includes information regarding the remaining percentage of the toner that is calculated by application of the correction factor from the D time point. In Equation 542 shown in FIG. 5, $R_{calc'}$ indicates the remaining life information of the toner cartridge to which the correction factor applied from the D time point.

Figure 6:
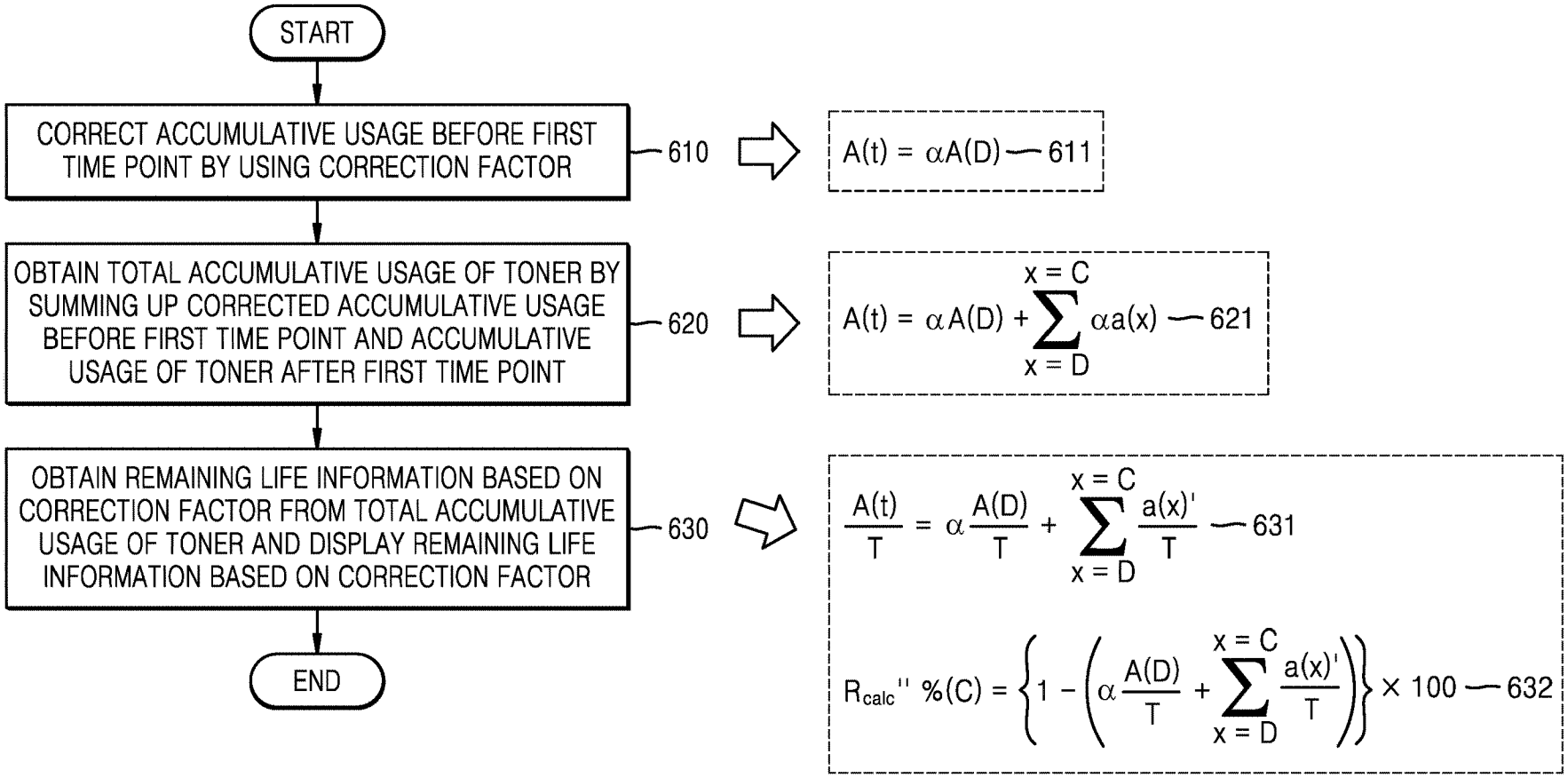
FIG. 6 is a diagram for describing a process of providing, by the image forming apparatus, remaining life information of the toner cartridge based on a correction factor, according to another example.

FIG. 6 is a diagram for describing a process of providing, by the image forming apparatus 10, remaining life information of the toner cartridge based on a correction factor, according to another example.

In operation 610 of the image forming apparatus 10, the image forming apparatus 10 may correct the accumulative usage before the first time point by using the correction factor.

For example, the image forming apparatus 10 may correct the cumulative usage of the toner before the D time point according to Equation 611 of FIG. 6. The image forming apparatus 10 may obtain a corrected accumulative usage $\alpha$*A(D) by multiplying the correction factor by the accumulative usage of the toner.

In operation 620 of the image forming apparatus 10, the image forming apparatus 10 may obtain a total accumulative usage of the toner by summing up the corrected accumulative usage before the first time point and the accumulative usage of the toner after the first time point.

For example, the image forming apparatus 10 may obtain the total accumulative usage of the toner up to the C time point by summing up the corrected accumulative usage before the D time point and a corrected accumulative usage from the D time point to the C time point, according to Equation 621 of FIG. 6. Referring to Equation 621, the correction factor is applied to the accumulative usage of the toner before the D time point and the accumulative usage of the toner from the D time point. Accordingly, the error between the accumulative usage of the toner and the actual accumulative usage of the toner may be reduced.

In operation 630 of the image forming apparatus 10, the image forming apparatus 10 may obtain remaining life information based on the correction factor from the total accumulative usage of the toner and display the remaining life information based on the correction factor.

For example, the image forming apparatus 10 may obtain an accumulative usage rate of the toner by calculating a rate of the total accumulation usage of the toner to the target usage of the toner, according to Equation 631 shown in FIG. 6. The image forming apparatus 10 may calculate a remaining percentage of the toner based on the correction factor by subtracting the accumulative usage rate of the toner from the initial remaining percentage 1 of the toner in the toner cartridge.

In other words, as the correction factor is applied to the accumulative usage up to the D time point, the image forming apparatus 10 may obtain remaining life information of the toner cartridge. The remaining life information includes information regarding a remaining percentage of the toner and is calculated by applying the correction factor to each time point. Here, each time point includes a time period from an initial time point to a last time point at which the toner is used due to the image forming operation. In Equation 632 of FIG. 6, $R_{calc'}$ indicates remaining life information of the toner cartridge to which the correction factor is applied from the D time point.

Figure 7:
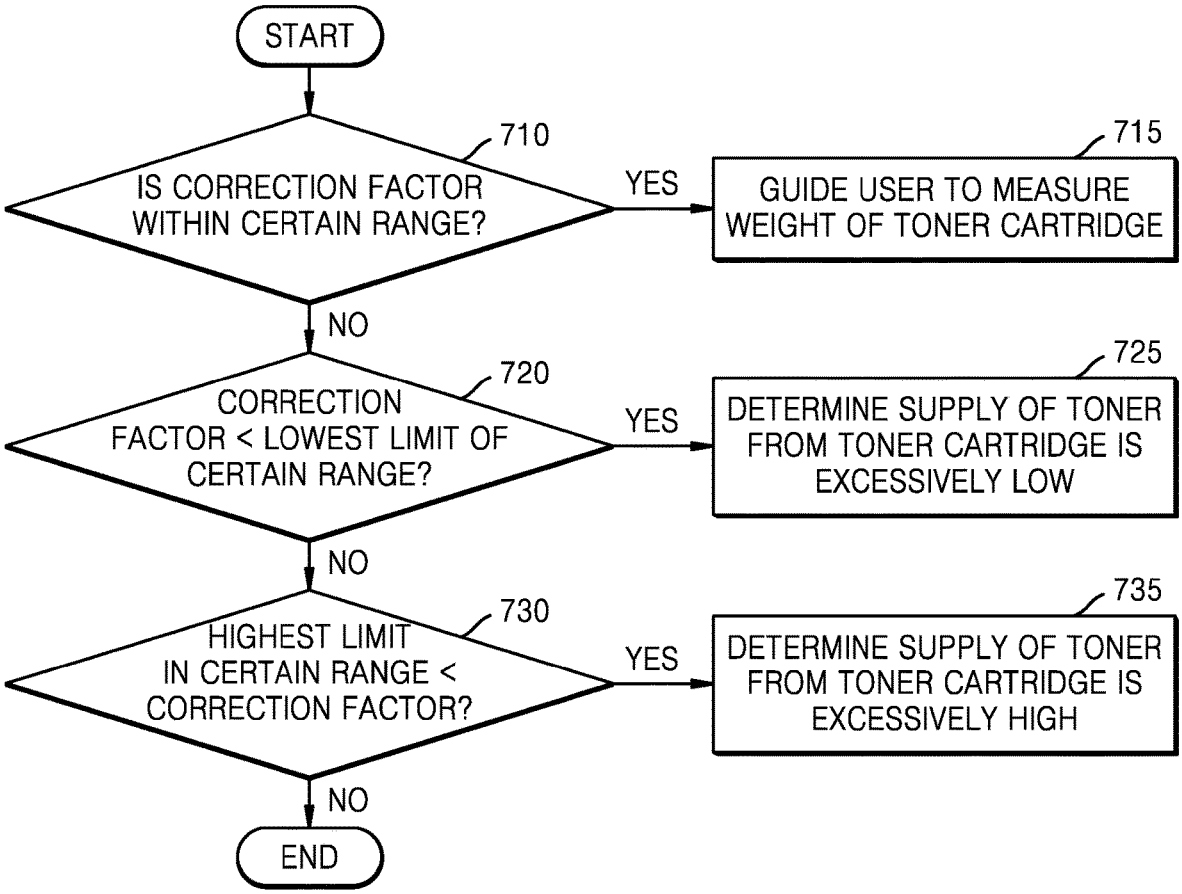
FIG. 7 is a diagram for describing a process of diagnosing a state of the image forming apparatus according to a correction factor, according to an example.

FIG. 7 is a diagram for describing a process of diagnosing a state of the image forming apparatus 10 according to a correction factor, according to an example.

In operation 710 of the image forming apparatus 10, the image forming apparatus 10 may identify whether the correction factor is within a predetermined range. For example, the predetermined range may be 0.8<the correction factor<1.2. The correction factor may exceed the predetermined range by a greater degree as the difference between the actual accumulated usage rate and the estimated accumulated usage rate increases. In other words, the correction factor may have a value out of the predetermined range. For example, when the correction factor is not within the predetermined range, the image forming apparatus 10 may perform operation 720. For example, when the correction factor is within the predetermined range, the image forming apparatus 10 may perform operation 715.

More particularly, in operation 715 of the image forming apparatus 10, the image forming apparatus 10 may determine that the image forming apparatus 10 is in the normal state. The correction factor may be a rate of the actual accumulative usage rate to the estimated accumulative usage. Accordingly, the correction factor may indicate the efficiency of supply of toner in the image forming apparatus 10. Accordingly, when the correction factor is near to 1, the image forming apparatus 10 may be diagnosed as being in the normal state. The image forming apparatus 10 may output a message for guiding the user to measure the weight of the toner cartridge. When the weight information indicating the weight of the toner cartridge is obtained by the image forming apparatus 10, the image forming apparatus 10 may obtain a correction factor for correcting the accumulative usage of the toner such that the error between the actual accumulative usage of the toner and the accumulative usage of the toner calculated by the image forming apparatus 10 is reduced. The image forming apparatus 10 may obtain remaining life information based on the correction factor.

In operation 720 of the image forming apparatus 10, the image forming apparatus 10 may determine whether the correction factor is less than a lowest limit of a predetermined range. For example, when the correction factor is not less than the lowest limit of the predetermined range, the image forming apparatus 10 may perform operation 730. As another example, when the correction factor is less than the lowest limit of the predetermined range, the image forming apparatus 10 may perform operation 725.

More particularly, in operation 725 of the image forming apparatus 10, the image forming apparatus 10 may determine that the accumulative usage of the toner is greater than the actual accumulative usage of the toner and supply of the toner from the toner cartridge is excessively low. The user may check the image forming apparatus 10 to detect elements that inhibit supply of the toner.

In operation 730 of the image forming apparatus 10, the image forming apparatus 10 may determine whether the correction factor is greater than a highest limit of the predetermined range. For example, when the correction factor is not greater than the highest limit of the predetermined range, the image forming apparatus 10 may end the operation. As another example, when the correction factor is greater than the highest limit of the predetermined range, the image forming apparatus 10 may perform operation 735.

More particularly, in operation 735 of the image forming apparatus 10, the image forming apparatus 10 may determine that the actual accumulative usage of the toner is greater than the accumulative usage of the toner and supply of the toner from the toner cartridge is excessively high. The user may check the image forming apparatus 10 to detect elements that excessively supply the toner.

Figure 8:
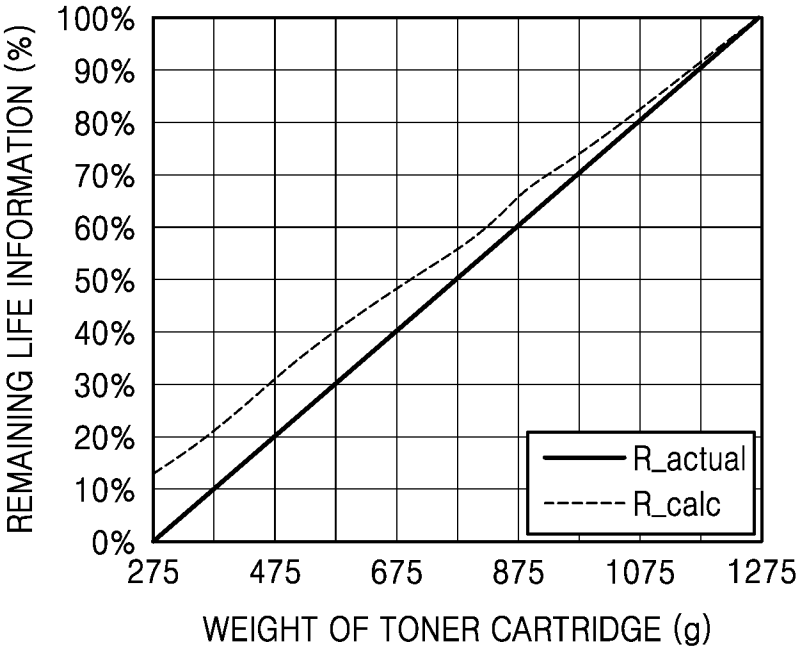
FIG. 8 is a diagram for describing a result of comparing actual remaining life information of the toner cartridge to remaining life information of the toner cartridge, the remaining life information being obtained by the image forming apparatus without using a correction factor, according to an example.

FIG. 8 is a diagram for describing a result of comparing actual remaining life information of the toner cartridge to remaining life information of the toner cartridge that is obtained by the image forming apparatus without using a correction factor, according to an example.

Table 810 shown in FIG. 8 represents the remaining life information of the toner cartridge that is calculated according to toner usage and the actual remaining life information of the toner cartridge that is obtained according to the weight of the toner.

Here, M indicates a weight of the toner cartridge measured at a certain time point, and $m_{_used}$ indicates an actual accumulative usage of the toner used in the toner cartridge to the certain time point. A indicates the number of accumulative dots calculated according to the toner usage. $R_{_calc}$ indicates the remaining life information of the toner cartridge, and $R_{_actual}$ indicates the actual remaining life information of the toner cartridge.

Referring to table 810 shown in FIG. 8, when the actual accumulative usage of the toner and the number of accumulative dots of the toner is 0, a weight of the toner cartridge is 1260 g. In other words, when the toner is charged in the toner cartridge, an initial weight of the toner cartridge is 1260 g. In addition, when a value of the actual remaining life information of the toner cartridge is 0, the weight of the toner cartridge is 275 g, and accordingly, when the toner is not charged in the toner cartridge, the weight of the toner cartridge is 275 g. The amount of toner charged in the toner cartridge is 985 g. It is assumed that the number of target accumulative dots for 985 g of the toner is 500000000.

Referring to a table 810 and a graph 820 shown in FIG. 8, as the toner in the toner cartridge is used, an error occurs between a value of $R_{_calc}$ and a value of $R_{_actual}$. For example, as it is shown in the graph 820 of FIG. 8, the error may occur as the calculated accumulative usage is less than the actual accumulative usage. As the calculated accumulative usage is less than the actual accumulative usage, the remaining amount of toner may be recognized as existing when the toner in the toner cartridge is actually used up in the image forming apparatus 10. When the toner in the toner cartridge is used up, the error between the value of $R_{_calc}$ and the value of $R_{_actual}$ may be in a range from about 10% to about 13%.

The error that occurred as the calculated accumulative usage is less than the actual accumulative usage is described with reference to FIG. 8, but an error may also occur as the calculated accumulative usage is greater than the actual accumulative usage.

Figure 9:
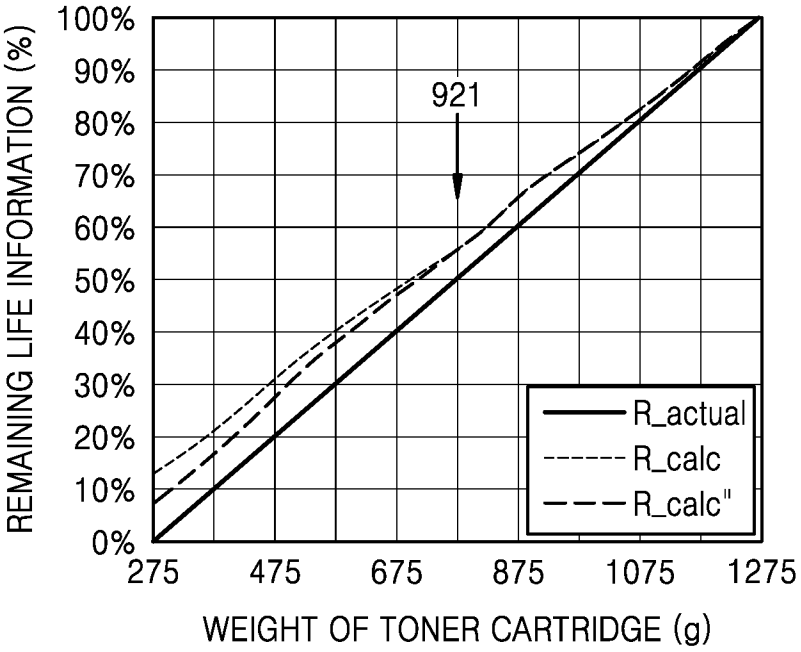
FIG. 9 is a diagram for describing a result of comparing actual remaining life information of the toner cartridge to remaining life information of the toner cartridge, the remaining life information being obtained by the image forming apparatus by using a correction factor, according to an example.

FIG. 9 is a diagram for describing a result of comparing actual remaining life information of the toner cartridge to remaining life information of the toner cartridge that is obtained by the image forming apparatus by using a correction factor, according to an example.

According to a table 910 and an arrow mark 921 of a graph 920 shown in FIG. 9, the image forming apparatus 10 may obtain a correction factor according to a weight of the toner cartridge that is measured when the weight of the toner cartridge is 810 g. The image forming apparatus 10 may obtain remaining life information of the toner cartridge by applying the correction factor to calculating accumulative dots after the time point at which the weight of the toner cartridge is 810 g.

Here, M indicates a weight of the toner cartridge measured at a certain time point, and $m_{_used}$ indicates an actual accumulative usage of the toner used in the toner cartridge up to the certain time point. A' indicates the number of accumulative dots calculated by applying the correction factor to the toner usage after the time point at which the weight of the toner cartridge is 810 g. Shaded regions in the table 910 of FIG. 9 indicate regions modified to be different from values of A and values of $R_{_cal}$ shown in the table 810 due to application of the correction factor. $R_{_calc'}$ indicates remaining life information of the toner cartridge that is obtained based on the correction factor, and $R_{_actual}$ indicates actual remaining life information of the toner cartridge.

Referring to the graph 920 of FIG. 9, an error between a value of $R_{_calc'}$ and a value of $R_{_actual}$ is less than the error between the value of $R_{_calc}$ and the value of $R_{_actual}$. When the toner in the toner cartridge is actually used up, an error between the $R_{_calc'}$ and the $R_{_actual}$ may be in a range from about 7% to about 8%. The error between the calculated remaining life and the remaining life may be reduced by obtaining the remaining life information of the toner cartridge by applying the correction factor.

Figure 10:
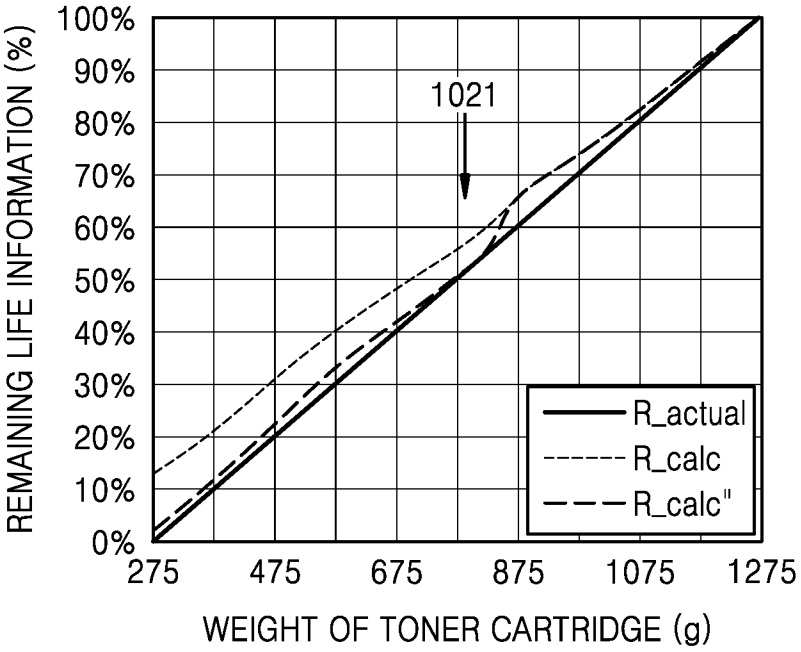
FIG. 10 is a diagram for describing a result of comparing actual remaining life information of the toner cartridge to remaining life information of the toner cartridge, the remaining life information being obtained by the image forming apparatus by using a correction factor, according to another example.

FIG. 10 is a diagram for describing a result of comparing actual remaining life information of the toner cartridge to remaining life information of the toner cartridge that is obtained by the image forming apparatus by using a correction factor, according to another example.

Referring to a table 1010 and an arrow mark 1021 of a graph 1020 shown in FIG. 10, the image forming apparatus 10 may obtain the correction factor according to the weight of the toner cartridge that is measured when the weight of the toner cartridge is 810 g. The image forming apparatus 10 may obtain a corrected number of accumulative dots by applying the correction factor to the number of accumulative dots calculated up to the time point at which the weight of the toner cartridge is 810 g. In addition, the image forming apparatus 10 may apply the correction factor to calculation of accumulative dots after the time point at which the weight of the toner cartridge is 810 g. The image forming apparatus 10 may obtain the remaining life information of the toner cartridge based on the correction factor from the time point at which the weight of the toner cartridge is 810 g.

Here, M indicates a weight of the toner cartridge measured at a certain time point, and $m_{_used}$ indicates an actual accumulative usage of the toner used in the toner cartridge up to the certain time point. A" indicates the number of accumulative dots calculated by applying the correction factor for toner usage from the time point at which the weight of the toner cartridge is 810 g. Shaded regions in the table 1010 of FIG. 10 indicate regions modified to be different from values of A and values of $R_{_calc}$ shown in the table 810, due to application of the correction factor. $R_{_calc}$" indicates remaining life information of the toner cartridge obtained based on the correction factor, and $R_{_actual}$ indicates actual remaining life information of the toner cartridge.

Referring to the graph 1020 shown in FIG. 10, an error between a value of $R_{_calc''}$ and a value of $R_{_actual}$ is less than an error between a value of $R_{_calc}$ and a value of $R_{_actual}$. When the toner in the toner cartridge is actually used up, the error occurring between the value of $R_{_calc'}$ and the value of $R_{_actual}$ may be in a range from about 2% to about 3%. The error between the calculated remaining life and the actual remaining life may be reduced by obtaining the remaining life information of the toner cartridge by applying the correction factor.

Figure 11:
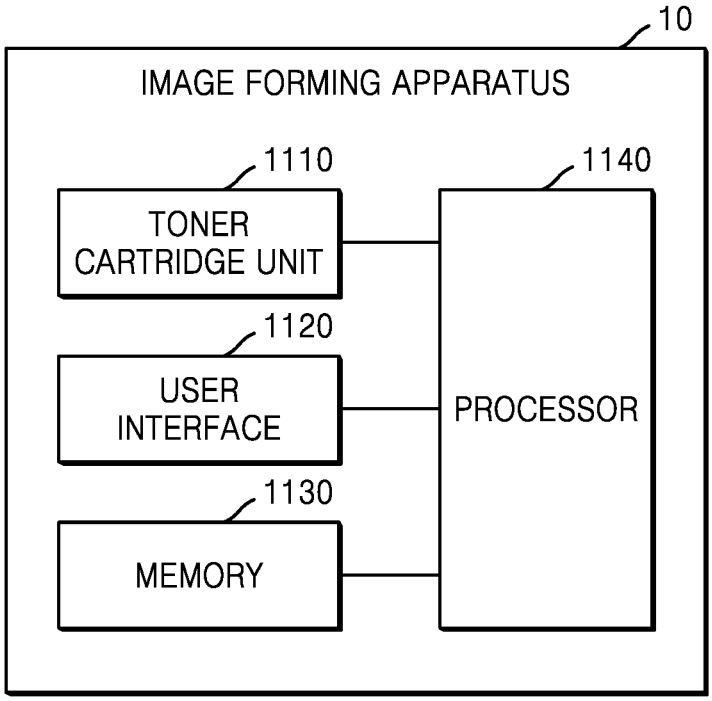
FIG. 11 is a block diagram of a configuration of the image forming apparatus, according to an example.

FIG. 11 is a block diagram of a configuration of the image forming apparatus 10, according to an example.

The image forming apparatus 10 shown in FIG. 11 may include a toner cartridge unit 1110, the user interface 1120, a memory 1130, and a processor 1140. However, not all the components shown in FIG. 11 are necessary components. The image forming apparatus 10 may be embodied by using less or more components than the components shown in the drawings. Hereinafter, the components will be described.

The toner cartridge unit 1110 may include a toner cartridge, a feed member for feeding toner, and a driving component for rotating the feed member.

The user interface 1120 may include an input unit for receiving input for performing the image forming operation from the user or an output unit for displaying a result of performing the image forming operation or information regarding a state of the image forming apparatus 10. For example, the user interface 1120 may include an operating panel receiving user inputs, a display panel displaying a screen, and the like.

For example, the input unit may include various devices like a keyboard, a physical button, a touch screen, a camera, or a microphone which are capable of receiving user inputs. The output unit may, for example, include a display panel, a speaker, or the like. However, the user interface 1120 is not limited to and may include various devices supporting input and output.

The user interface 1120 may receive input of the information of the toner cartridge. For example, the user interface 1120 may receive input of information including an initial weight of the toner cartridge when the toner cartridge is charged with the toner and a weight of the toner cartridge that is not charged with the toner. In addition, the user interface 1120 may receive input of weight information regarding the weight of the toner cartridge that is measured at a certain time point.

Furthermore, the user interface 1120 may, as the toner is used in the image forming apparatus 10, display the remaining life information of the toner cartridge. For example, the remaining life information may include information of a remaining amount of the toner, a remaining percentage of the toner, and the like.

The memory 1130 may store a program, data, or a file relevant to the image forming apparatus 10. The processor 1140 may execute the program stored in the memory 1130, read the data or file stored in the memory 1130, or store a new file in the memory 1130. The memory 1130 may, independently or in combination, store a program instruction, a data file, a data structure, and the like. The memory 1130 may store instructions that may be executed by the processor 1140.

For example, the memory 1130 may store a program which obtains a correction factor indicating an error rate of an accumulative usage and an actual accumulative usage of the toner, obtains remaining life information of the toner cartridge based on the correction factor, and provides the remaining life information to the user, when a weight of the toner cartridge is measured at a certain time point. In addition, the memory 1130 may store an amount of toner usage, an accumulative usage, an actual accumulative usage, remaining life information, actual remaining life information, a correction factor, a weight of the toner cartridge, the number of accumulative dots in the toner cartridge, which are obtained from the processor 1140.

The processor 1140 may control all operations of the image forming apparatus 10 and include at least one processor like a central processing unit (CPU). The processor 1140 may control other components in the image forming apparatus 10 to perform operations corresponding to the user input received through the user interface 1120. The processor 1140 may include at least one specialized processor corresponding to functions or an all-in-one type processor.

As the image forming operation is performed, the processor 1140 may obtain remaining life information of the toner cartridge for a remaining amount of toner by using an estimated accumulative usage of the toner in the toner cartridge.

The processor 1140 may calculate an accumulative usage rate of the toner, the usage rate indicating an accumulative usage of the toner to the target usage of the toner.

For example, the processor 1140 may calculate the accumulative usage of the toner, based on at least one of the number of rotations of the driving component rotating the feed member for feeding the toner in the toner cartridge, the driving time of the driving component, and the number of pixels of the image data for forming an image.

The processor 1140 may, from the accumulative usage of the toner, obtain remaining life information of the toner cartridge including the remaining percentage information of the toner. The processor 1140 may display the remaining life information of the toner cartridge on the user interface 1120 by controlling the user interface 1120.

The processor 1140 may obtain the weight information indicating the first weight of the toner cartridge at the first time point where the remaining amount of the toner is within a predetermined range.

For example, when the remaining amount of toner is within the predetermined range, the processor 1140 may display a message for guiding the user to measure the weight of the toner cartridge by controlling the user interface 1120 such that a difference between the actual accumulative usage of the toner and the accumulative usage of the toner calculated and estimated in the forming apparatus 10 is reduced. For example, the user may measure the weight of the toner cartridge by removing the toner cartridge from the image forming apparatus 10. The user may input the weight of the toner cartridge through the user interface 1120 in the image forming apparatus 10.

When a sensor is provided in the image forming apparatus 10, the sensor may measure the weight of the toner cartridge. The sensor may, to the processor 1140, provide weight information including the measured weight of the toner cartridge.

The processor 1140 may, based on the weight information, obtain a correction factor indicating an error rate between the accumulative usage of the toner and the actual accumulative usage of the toner.

For example, the processor 1140 may obtain the first difference value by calculating a difference between the initial weight of the toner cartridge when the toner is charged in the toner cartridge and the first weight of the toner cartridge. Here, the first weight is a weight of the toner cartridge measured at the first time point. The first difference value is the actual accumulative usage of the toner consumed in the toner cartridge to the first time point.

The processor 1140 may obtain the second difference value by calculating a difference between an initial weight of the toner cartridge charged with the toner and a weight of the toner cartridge that is not charged with the toner. The second difference value is an amount of toner initially charged in the toner cartridge. That is, the second difference value may be the target usage of the toner.

The processor 1140 may obtain the actual accumulative usage rate of the toner cartridge by calculating a rate of the first difference value to the second difference value. The processor 1140 may obtain actual remaining life information of the toner cartridge by using the actual accumulative usage rate.

The processor 1140 may, as a correction factor, obtain a rate of the actual accumulative usage rate of the toner cartridge to the accumulative usage of the toner cartridge.

Meanwhile, when the toner in the toner cartridge is directly supplied to the developing portion in the image forming apparatus 10, the processor 140 may reset the correction factor each time the toner cartridge is replaced. The processor 1140 may obtain weight information of the replaced toner cartridge at the first time point where the remaining amount of toner of the replaced toner cartridge is within a predetermined range. The weight information of the replaced toner cartridge may be obtained according to the above-mentioned method of obtaining the weight information of the toner cartridge. The processor 1140 may reestablish the correction factor that is reset, based on the weight information of the replaced toner cartridge. A correction factor may be reestablished according to the above-mentioned method of obtaining the correction factor.

On the other hand, when the toner in the toner cartridge is indirectly supplied to the developing portion in the image forming apparatus 10 through a storage space in the image forming apparatus 10, the processor 1140 may, as the weight information of the toner cartridge is obtained, reestablish a following correction factor, based on a previous correction factor. The following correction factor may be reestablished according to the above-mentioned method of obtaining the correction factor.

The processor 1140 may, by using the correction factor, correct the amount of toner to be used in the image forming operation to be performed after the first time point and obtain remaining life information based on the correction factor.

More particularly, the processor 1140 may, by using the correction factor, correct the amount of toner to be used in the image forming operation to be performed after the first time point. The processor 1140 may obtain an accumulative usage of the toner after the first time point by summing up the corrected amount of toner. The processor 1140 may obtain a total accumulative usage of the toner by summing up the accumulative usage of the toner before the first time point and the accumulative usage of the toner after the first time point. The processor 1140 may, from the total accumulative usage of the toner, obtain remaining life information based on the correction factor. The image forming apparatus 10 may display the remaining life information based on the correction factor.

For example, the processor 1140 may obtain the accumulative usage rate of the toner by calculating a rate of the total accumulative usage of the toner to the target usage of the toner. The processor 1140 may calculate the remaining percentage of the toner based on the correction factor by subtracting the accumulative usage rate of the toner from the initial remaining percentage 1 of the toner in the toner cartridge.

In other words, the processor 1140 may obtain remaining life information of the toner cartridge. The remaining life information includes information regarding the remaining percentage of the toner that is calculated by applying the correction factor from a time point at which the weight of the toner cartridge is measured.

The processor 1140 may correct the accumulative usage before the first time point by using the correction factor.

The processor 1140 may obtain the total accumulative usage of the toner by summing up a corrected accumulative usage before the first time point and the accumulative usage of the toner after the first time point. Accordingly, an error between the accumulative usage of the toner and the actual accumulative usage of the toner may be reduced.

The processor 1140 may obtain the remaining life information based on the correction factor from the total accumulative usage of the toner and may control the user interface 1120 to display the remaining life information based on the correction factor on the user interface 1120.

For example, the processor 1140 may obtain the accumulative usage rate of the toner by calculating the rate of the total accumulative usage to the target usage of the toner. The processor 1140 may subtract the accumulative usage rate of the toner from the initial remaining percentage 1 of the toner in the toner cartridge to calculate the remaining percentage of the toner based on the correction factor.

In other words, as the correction factor is applied to the accumulative usage of the toner cartridge from an initial time point to a time point at which the weight of the toner cartridge is measured, the processor 1140 may obtain remaining life information of the toner cartridge. The remaining life information of the toner cartridge includes information regarding a remaining percentage of the toner and is calculated by applying the correction factor to each time point. Here, each time point includes a time period from an initial time point to a last time point at which the toner is used due to the image forming operation.

The processor 1140 may determine whether the correction factor is within a predetermined range. As a result of the determination, when the correction factor is within the predetermined range, the processor 1140 may determine that the image forming apparatus 10 is in the normal state. The processor 1140 may control the user interface 1120 to display a message for guiding the user to measure a weight of the toner cartridge on the user interface 1120. When the weight information indicating the weight of the toner cartridge is input from the user interface 1120, the processor 1140 may obtain a correction factor used for correcting an accumulative usage of the toner, such that the error between the accumulative usage of the toner and the actual accumulative usage of the toner calculated due to the image forming operation is reduced. The processor 1140 may obtain remaining life information based on the correction factor.

The processor 1140 may determine whether the correction factor is less than a lowest limit in a predetermined range. As a result of the determination, when the correction factor is less than the lowest limit of the predetermined range, the processor 1140 may determine that the accumulative usage of the toner is greater than the actual accumulative usage of the toner and supply of the toner from the toner cartridge is excessively low.

The processor 1140 may determine whether the correction factor is greater than a highest value in the predetermined range. As a result of the determination, when the correction factor is greater than the highest value in the predetermined range, the processor 1140 may determine that the actual accumulative usage of the toner is greater than the accumulative usage of the toner and supply of the toner from the toner cartridge is excessively high.

Meanwhile, the operating method of the image forming apparatus 10 may be embodied in the form of instructions executable by a computer or a processor or a computer-readable storage medium that stores data. The method of operating the image forming apparatus 10 may be written as computer programs and may be implemented in general-use digital computers that execute the programs using a computer readable recording medium. The above-mentioned computer readable recording medium may be read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, a magnetic tape, floppy disc, a magnet optical recording medium, an optical data recording medium, hard disc, solid-state disc (SSD), and any kind of device capable of storing instructions of machine readable instructions, relevant data, data files, and data structure and capable of providing instructions or machine readable instructions, relevant data, data files, and data structures to a processor and a computer such that the processor or computer may execute the instruction.

While the present disclosure has been particularly shown and described with reference to limited examples, it will be understood by those of ordinary skill in the art that various changes in form and details may be made from therein. For example, when the above-mentioned methods performed in different orders, the above-mentioned components, for example, systems, structures, apparatuses, or circuits are combined or assembled in different forms or replaced by other components, technical goals of the present disclosure may be achieved.

Therefore, the scope of the present disclosure is defined not by the detailed description of the present disclosure but by the appended claims and equivalents thereof.

What is claimed is:

1. An operating method of an image forming apparatus, the operating method comprising:

estimating an accumulative usage of toner in a toner cartridge based on an image forming operation being performed;

determining initial remaining life information of the toner cartridge and indicating a remaining amount of the toner based on the estimated accumulative usage of the toner in the toner cartridge;

outputting a message to guide a user to measure a weight of the toner cartridge based on the remaining amount of the toner being within a predetermined range;

obtaining weight information indicating a first weight of the toner cartridge at a first time point at which the remaining amount of the toner is within the predetermined range;

determining a correction factor indicating an error factor between the estimated accumulative usage of the toner and an actual accumulative usage of the toner, based on the obtained weight information and the estimated accumulative usage; and correcting an amount of toner to be used in an image forming operation to be performed after the first time point based on the correction factor, and determining adjusted remaining life information based on the correction factor.

2. The operating method of claim 1, wherein the determining of the initial remaining life information of the toner cartridge based on the estimated accumulative usage of the toner cartridge comprises:

determining an estimated accumulative usage ratio of the toner, the estimated accumulative usage ratio indicating a ratio of the accumulative usage of the toner to a target usage of the toner;

determining, from the estimated accumulative usage ratio of the toner, the initial remaining life information of the toner cartridge including information of a remaining percentage of the toner; and displaying the initial remaining life information of the toner cartridge.

3. The operating method of claim 2, wherein the determining of the correction factor indicating the error factor between the estimated accumulative usage of the toner and the actual accumulative usage of the toner, based on the obtained weight information, comprises:

determining a first difference value between an initial weight of the toner cartridge in an initial state in which the toner cartridge is charged with the toner and the first weight, and a second difference value between the initial weight and a weight of the toner cartridge in a state in which the toner cartridge is not charged with the toner;

determining an actual accumulative usage ratio of the toner cartridge based on a ratio of the first difference value to the second difference value; and determining the correction factor based on a ratio of the actual accumulative usage ratio of the toner cartridge to the estimated accumulative usage ratio of the toner cartridge.

4. The operating method of claim 1, wherein the determining of the adjusted remaining life information based on the correction factor comprises:

determining an accumulative usage of the toner after the first time point by summing the corrected amount of toner to be used;

determining a total accumulative usage of the toner by summing the estimated accumulative usage of the toner before the first time point and the accumulative usage of the toner after the first time point;

determining, from the total accumulative usage of the toner, the adjusted remaining life information based on the correction factor, and displaying the adjusted remaining life information based on the correction factor.

5. The operating method of claim 4, wherein the determining of the total accumulative usage of the toner comprises:

correcting, based on the correction factor, the estimated accumulative usage before the first time point; and determining the total accumulative usage by summing the corrected accumulative usage before the first time point and the accumulative usage of the toner after the first time point.

6. The operating method of claim 1, further comprising diagnosing the image forming apparatus, based on the correction factor being out of a predetermined range, as being in a state having defects and displaying a result of the diagnosing.

7. The operating method of claim 6, wherein the diagnosing of the state of the image forming apparatus comprises:

diagnosing that supply of the toner from the toner cartridge is excessively low by determining that the estimated accumulative usage of the toner is greater than the actual accumulative usage of the toner, based on the correction factor being less than a lowest value of the predetermined range of the correction factor; and diagnosing that supply of the toner from the toner cartridge is excessively high by determining that the actual accumulative usage of the toner is greater than the estimated accumulative usage of the toner, when based on the correction factor is being greater than a highest value of the predetermined range of the correction factor.

8. The operating method of claim 1, wherein the estimating of the accumulative usage of the toner is based on at least one of a number of rotations of a driving component to rotate a feed member to feed the toner in the toner cartridge, a driving time, or a number of pixels of image data to form an image.

9. The operating method of claim 1, further comprising, based on the toner in the toner cartridge being directly supplied to a developing portion in the image forming apparatus, resetting the correction factor each time the toner cartridge is replaced, and reestablishing the reset correction factor based on weight information of the replaced toner cartridge being obtained.

10. The operating method of claim 1, further comprising, based on the toner in the toner cartridge being indirectly supplied to a developing portion in the image forming apparatus via a storage space, reestablishing a next correction factor based on the determined correction factor as the weight information of the toner cartridge is obtained.

11. A computer program stored in a medium so as to be executed in combination with an image forming apparatus, the computer program comprising:

instructions to estimate an accumulative usage of toner in a toner cartridge based on an image forming operation being performed;

instructions to determine initial remaining life information of the toner cartridge corresponding to a remaining amount of the toner based on the estimated accumulative usage of the toner in the toner cartridge;

instructions to output a message to guide a user to measure a weight of the toner cartridge based on the remaining amount of the toner being within a predetermined range;

instructions to obtain weight information indicating a first weight of the toner cartridge at a first time point at which the remaining amount of the toner is within the predetermined range;

instructions to determine a correction factor indicating an error factor between the estimated accumulative usage of the toner and an actual accumulative usage of the toner, based on the obtained weight information and the estimated accumulative usage; and instructions to correct, based on the correction factor, an amount of toner to be used in an image forming operation to be performed after the first time point, and determine adjusted remaining life information based on the correction factor.

12. An image forming apparatus comprising:

a main body in which a toner cartridge is mounted;

a user interface;

a processor; and a memory storing instructions executable by the processor, wherein the processor, by executing the instructions, is to:

estimate an accumulative usage of toner in the toner cartridge based on an image forming operation being performed, determine initial remaining life information of the toner cartridge corresponding to a remaining amount of the toner based on the estimated accumulative usage of the toner in the toner cartridge, output a message to guide a user to measure a weight of the toner cartridge based on the remaining amount of the toner being within a predetermined range, obtain weight information indicating a first weight of the toner cartridge at a first time point at which the remaining amount of the toner is within the predetermined range, determine a correction factor indicating an error factor between the estimated accumulative usage of the toner and an actual accumulative usage of the toner, and correct, based on the correction factor, an amount of toner to be used in an image forming operation to be performed after the first time point and determine adjusted remaining life information based on the correction factor.

13. The image forming apparatus of claim 12, wherein the processor, by executing the instructions, is to:

receive, through the user interface, information regarding an initial weight based on the toner being charged in the toner cartridge and a weight of the toner cartridge based on the toner not being charged in the toner cartridge, determine, at the first time point based on the first weight information being received through the user interface, a first difference value between the initial weight and the first weight and a second difference value between the initial weight and the weight of the cartridge based on the toner not being charged in the toner cartridge, determine an actual accumulative usage ratio of the toner cartridge based on a ratio of the first difference value to the second difference value, and determine the correction factor based on a ratio of the actual accumulative usage of the toner cartridge to the estimated accumulative usage of the toner cartridge.

14. The image forming apparatus of claim 12, wherein the processor, by executing the instructions, is to:

determine an accumulative usage of the toner after the first time point by summing the corrected amount of toner to be used, determine a total accumulative usage of the toner by summing the estimated accumulative usage of the toner before the first time point and the accumulative usage of the toner after the first time point, determine the adjusted remaining life information based on the correction factor, from the total accumulative usage of the toner, and display, through the user interface, the adjusted remaining life information based on the correction factor.

15. The image forming apparatus of claim 14, wherein the processor, by executing the instructions, is to:

correct, based on the correction factor, the estimated accumulative usage before the first time point; and determine the total accumulative usage by summing the corrected accumulative usage before the first time point and the accumulative usage of the toner after the first time point.

16. The image forming apparatus of claim 12, wherein the processor, by executing the instructions, is to:

determine an estimated accumulative usage ratio of the toner, the estimated accumulative usage ratio indicating a ratio of the accumulative usage of the toner to a target usage of the toner;

determine, from the estimated accumulative usage ratio of the toner, the initial remaining life information of the toner cartridge including information of a remaining percentage of the toner; and display the initial remaining life information of the toner cartridge.

17. The image forming apparatus of claim 12, wherein the processor, by executing the instructions, is to diagnose the image forming apparatus, based on the correction factor being out of a predetermined range, as being in a state having defects and displaying a result of the diagnosing.

18. The image forming apparatus of claim 17, wherein the processor, by executing the instructions, is to:

diagnose that supply of the toner from the toner cartridge is excessively low by determining that the estimated accumulative usage of the toner is greater than the actual accumulative usage of the toner, based on the correction factor being less than a lowest value of the predetermined range of the correction factor; and diagnose that supply of the toner from the toner cartridge is excessively high by determining that the actual accumulative usage of the toner is greater than the estimated accumulative usage of the toner, based on the correction factor being greater than a highest value of the predetermined range of the correction factor.

19. The image forming apparatus of claim 12, wherein the estimating of the accumulative usage of the toner is based on at least one of a number of rotations of a driving component to rotate a feed member to feed the toner in the toner cartridge, a driving time, or a number of pixels of image data to form an image.

20. The image forming apparatus of claim 12, wherein the processor, by executing the instructions, is to:

based on the toner in the toner cartridge being directly supplied to a developing portion in the image forming apparatus, reset the correction factor each time the toner cartridge is replaced, and reestablish the reset correction factor based on weight information of the replaced toner cartridge being obtained; or based on the toner in the toner cartridge being indirectly supplied to a developing portion in the image forming apparatus via a storage space, reestablish a next correction factor based on the determined correction factor as the weight information of the toner cartridge is obtained.

* * * * *